US005700615A

United States Patent [19]

Silence et al.

[11] Patent Number: 5,700,615

[45] Date of Patent: *Dec. 23, 1997

[54] COATED CARRIER PARTICLES

[75] Inventors: Scott M. Silence, Fairport; John A. Creatura, Ontario; Bing R. Hsieh; Ronald F. Ziolo, both of Webster; Richard W. Ellis, Rochester, all of N.Y.

[73] Assignee: Xerox Corporation, Stamford, Conn.

[ * ] Notice: The term of this patent shall not extend beyond the expiration date of Pat. No. 5,595,851.

[21] Appl. No.: 785,675

[22] Filed: Jan. 21, 1997

[51] Int. Cl.[6] ..... G03G 9/107; G03G 9/113

[52] U.S. Cl. ..... 430/106.6; 430/108; 430/137

[58] Field of Search ..... 430/106.6, 108, 430/137

[56] References Cited

U.S. PATENT DOCUMENTS

| | | | |
|---|---|---|---|
| 4,233,387 | 11/1980 | Mammino et al. | 430/137 |
| 4,560,635 | 12/1985 | Hoffend et al. | 430/106.6 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,229,242 | 7/1993 | Mahabadi et al. | 430/106.6 |
| 5,595,851 | 1/1997 | Creatura et al. | 430/108 |

*Primary Examiner*—Roland Martin
*Attorney, Agent, or Firm*—E. O. Palazzo

[57] ABSTRACT

A composition comprised of a core and thereover a mixture of a first and second polymer, and wherein said first polymer contains a conductive component, and said second polymer contains copper iodide.

28 Claims, No Drawings

COATED CARRIER PARTICLES

BACKGROUND OF THE INVENTION

This invention is generally directed to developer compositions, and more specifically, the present invention relates to developer compositions with coated carrier particles prepared by dry powder processes. In embodiments of the present invention, the carrier particles are comprised of a core with polymeric mixture coating thereover, and more specifically, a mixture of two polymers, and dispersed in one polymer conductive components, such as carbon black, and dispersed in the second polymer a copper iodide, especially cuprous iodide, thereby enabling carriers with excellent high conductivity ranges of from about $10^{-10}$ to about $10^{-7}$ ohm/cm, and a large tribo range of from about a minus (–) 30 to a plus 30 microcoulombs per gram. The carrier particles prepared in accordance with the processes of the present invention contain cuprous iodide in certain important amounts to enable in combination with the polymer/conductive coating a large carrier conductivity range, and a wide carrier triboelectric range and wherein the carriers generated can be selected for a number of different xerographic copies and printers wherein carriers with certain specific conductivity and certain tribo charge are required. Developer compositions comprised of the carrier particles illustrated herein and prepared, for example, by a dry coating process are useful in electrostatographic or electrophotographic imaging systems, especially xerographic imaging and printing processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and disperant component applied to the carrier core, the conductive component selected, and the amount of cuprous iodide selected. Further, in embodiments the carrier core can contain a first continuous polymer coating, such as polymethacrylate, or a reactive extruded polyester, and dispersed therein conductive components, such as conductive carbon blacks or metal oxides in amounts, for example, of from about 1 to about 70, and preferably from about 10 to about 60 weight percent, and a second polymer with cuprous iodide contained therein in an amount of, for example, from about 75 to about 95 weight percent.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that enable continued constant developed images of high quality and excellent resolution.

Additionally, carrier particles for use in the development of electrostatic latent images are described in many patents including, for example, U.S. Pat. No. 3,590,000. These carrier particles may consist of various cores, including steel, with a coating thereover of fluoropolymers, and terpolymers of styrene, methacrylate, and silane compounds. Past efforts have focused on the attainment of coatings for carrier particles for the purpose of improving development quality, and also to permit particles that can be recycled, and that do not adversely effect the imaging member in any substantial manner. A number of coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coating resides in fluctuating triboelectric charging characteristics, particularly with changes in relative humidity. The aforementioned modification in triboelectric charging characteristics provides developed images of lower quality, and with background deposits.

There is illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles can be substantially constant, and moreover, the triboelectric values can be selected to vary significantly, for example, from less than –30 microcoulombs per gram to +40 microcoulombs per gram.

There is illustrated in U.S. Pat. No. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, them is disclosed that there can be added to carrier coatings colorless conductive metal halides in an amount of from about 25 to about 75 weight percent, such halides including copper iodide, copper fluoride, and mixtures thereof. In the '611 patent, the conductivity ranges are considered relatively narrow, and the carrier tribocharge is not believed to be of a wide range, disadvantages overcome, or minimized with the present invention.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and, therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high and useful triboelectric charging values with finely divided toner particles; and also wherein the carrier particles are of substantially constant conductivity. Further, when resin coated carrier particles are prepared by the powder coating process of the present invention, the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations. Thus, for example, there can be formulated in accordance with the invention of the present application developers with conductivities of from about $10^{-6}$ ohm-cm to about $10^{-17}$ ohm-cm, about $10^{-10}$ ohm-cm to about $10^{-6}$, and preferably from about $10^{-8}$ ohm-cm to about $10^{-6}$ ohm-cm, determined in a magnetic brush conducting cell, and a wide carrier triboelectric charging value of from about −30 to about +40, and in embodiments of from about −15 to about +20 microcoulombs per gram on the carrier particles as determined by the known Faraday Cage technique. Thus, the developers of the present invention can be formulated with constant conductivity values with different triboelectric charging characteristics by, for example, maintaining the same total coating weight on the carrier particles and changing the amount of cuprous iodide and conductive component ratio. Similarly, there can be formulated developer compositions wherein constant triboelectric charging values are achieved and the conductivities are altered by retaining the same total coating weight on the carrier particles.

Other U.S. Patents that may be of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798, 167; 3,918,968; 3,922,382; 4,238,558; 4,310,611; 4,397,935; and 4,434,220, the disclosures of each of these patents being totally incorporated herein by reference.

SUMMARY OF THE INVENTION

It is an object of the present invention to provide toner and developer compositions with carrier particles containing a polymer coating.

In another object of the present invention there are provided dry coating processes for generating carrier particles of substantially constant conductivity parameters.

In yet another object of the present invention there are provided dry coating processes for generating carrier particles of substantially constant conductivity parameters, and a wide range of preselected triboelectric charging values.

In yet a further object of the present invention there are provided carrier particles with a coating of a polymer and dispersed in the polymer conductive particles, and cuprous iodide.

In embodiments of the present invention there are provided developer compositions comprised of toner particles, and carrier particles prepared by a powder coating process, and wherein the carrier particles are comprised of a core with a certain coatings thereover. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of a first polymer especially polymethacrylate, and which polymer has dispersed therein carbon black or similar conductive component, and a second polymer containing cuprous iodide in certain important amounts, until adherence thereof to the carrier core by mechanical impaction or electrostatic attraction; heating the resulting mixture of carrier core particles and polymer to a temperature, for example, of between from about 200° F. to about 550° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Embodiments of the present invention include a composition comprised of a core, and thereover a mixture of a first and second polymer, and wherein said first polymer contains a conductive component, and said second polymer contains copper iodide; a carrier composition wherein the copper iodide is cuprous iodide present in an amount of from about 75 to about 95 weight percent based on the amount of the second polymer and the iodide; a carrier with two polymers thereover and wherein the conductive component for the first polymer is a metal oxide, or preferably carbon black, wherein the conductive component for said first polymer is carbon black selected in an amount of from about 15 to about 50 weight percent; wherein the first polymer is a polyester, or a styrene based polymer, and the second polymer is polymethylmethacrylate, wherein the first polymer is selected in an amount of from about 1 to about 99 weight percent and the second polymer is selected in an amount of from about 99 to about 1 weight percent; or wherein the carrier core is a metal, a ferrite, a metal oxide, and the like such as known carrier cores.

Various suitable solid core carrier materials can be selected for the developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characterExampl. Examples of carrier cores that can be selected include iron, steel, ferrites such as Sr (strontium)-ferrite, Ba-ferrite, Cu/Zn-ferrite, and Ni/Zn-ferrite, magnetites, nickel, mixtures thereof, and the like. Preferred carrier cores include ferrites, and sponge iron, or steel grit with an average particle size diameter of from between about 30 microns to about 200 microns.

The first polymer coating has dispersed therein conductive components, such as metal oxides like tin oxide, conductive carbon blacks, and the like, in effective amounts of, for example, from about 1 to about 70 and preferably from about 15 to about 60 weight percent. Specific examples of conductive components include the conductive carbon black SC Ultra manufactured by Conductex, Inc., and antimony-doped tin oxide Zelec ECP3005-XC manufactured by DuPont.

Of importance with respect to the present invention is the presence of cuprous iodide in at least one polymer coating, and more specifically, in a second polymer that contains no other conductive component, which iodide is preferably present in an amount of at least 75 percent by weight, and more specifically, from about 75 to about 95 weight percent. With the combination of two polymers, conductive component and iodide containing component, there are enabled the advantages of the present invention, including the wide ranges of carrier tribo and carrier conductivity as indicated herein. For example, a polymer coating comprised of a combination of powders of (1) 19 percent by weight of Conductex SC Ultra conductive carbon black incorporated into poly(methylmethacrylate) polymer, and (2) 80 percent by weight of cuprous iodide incorporated into a reactive extruded polyester will provide carrier triboelectric values of from about −10 microcoulombs per gram to about +10 microcoulombs per gram depending on the relative ratios of the two polymers used, at conductivities greater than about $5\times10^{-10}$ mhos per centimeter.

The process for incorporating these polymers onto a carrier core can be sequential, a process in which one of the two polymers is fused to the surface in a first step and the second polymer is fused to the surface in a subsequent fusing step. Alternatively, the process for incorporation can comprise a single fusing step in which the two polymers, which are mixed with each other prior to the fusing process, are incorporated onto the core in a single fusing step.

Also, the carrier coating can have incorporated therein various charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as specifically illustrated herein, and other effective known charge agents or additives. The charge additives are selected in various effective amounts, such as from about 0.05 to about 15 weight percent.

Examples of first and second polymers selected include polymethacrylate, polyvinylidenefluoride, polyvinylfluoride, polypentafluorostyrene, polyethylene, polymethylmethacrylate, copolyethylenevinylacetate, copolyvinylidenefluoride tetrafluoroethylene, and polyethylene; polymethylmethacrylate, polyurethane and copolyethylene, and preferably wherein the first and second polymers are dissimilar. Other known related polymers not specifically mentioned herein may also be selected, such as those illustrated in the U.S. Pat. No. 4,937,166 and 4,935,326 patents mentioned herein.

Various effective suitable processes can be selected to apply the polymer, or mixture of polymer coatings to the surface of the carrier particles. Examples of typical processes for this purpose include combining the carrier core material, and the polymers with cuprous iodide and conductive component by cascade roll mixing, or tumbling, milling, shaking, electrostatic powder cloud spraying, fluidized bed, electrostatic disc processing, and an electrostatic curtain. Following application of the polymers, heating is initiated to permit flowout of the coating material over the surface of the carrier core. The concentration of the coating material powder particles, and the parameters of the heating step, may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-9}$ to about $10^{-17}$ mho-cm$_{-1}$ as measured, for example, across a 0.1 inch magnetic brush at an applied potential of 10 volts; and wherein the coating coverage encompasses from about 10 percent to about 100 percent of the carrier core.

Illustrative examples of toner resins selected for the toner which when admixed with carrier generates developer compositions includes a number of thermoplastics, such as polyamides, epoxies, polyurethanes, diolefins, vinyl resins, polyesters, such as those obtained by the polymeric esterification products of a dicarboxylic acid and a diol comprising a diphenol. Specific vinyl monomers that can be used are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one preferred toner resin there can be selected the esterification products of a dicarboxylic acid and a diol comprising a diphenol, reference U.S. Pat. No. 3,590,000, the disclosure of which is totally incorporated herein by reference. Other preferred toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol.

Generally, from about 1 part to about 5 parts by weight of toner particles are mixed with from about 10 to about 300 parts by weight of the carrier particles.

Numerous well known suitable pigments or dyes, and preferably pigments can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment is present in amounts of from about 1 percent by weight to about 20, and preferably from about 5 to about 12 percent by weight, based on the total weight of the toner composition, however, lesser or greater amounts of pigment may be selected.

When the pigment particles are comprised of magnetites, which are a mixture of iron oxides ($FeO \bullet Fe_2O_3$) including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black like REGAL 330®, is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Also, there may be selected colored toner compositions comprised of toner resin particles, carrier particles and as pigments or colorants, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives. These additives are usually incorporated into the toner in an amount of from about 0.1 percent by weight to about 20 percent by weight. These charge additives can also be dispersed in the carrier polymer coating as indicated herein.

The toner composition of the present invention can be prepared by a number of known methods including melt blending the toner resin particles, and pigment particles or colorants of the present invention followed by mechanical attrition, emulsion/aggregation, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments, squaraine compounds, thiapyrillium materials, and the like. These layered members are conventionally charged negatively thus requiring a positively charged toner.

Images obtained with this developer composition had acceptable solids, excellent halftones, and desirable line resolution with acceptable or substantially no background deposits.

The following Examples are being supplied to further define the present invention, it being noted that these Examples are intended to illustrate and not limit the scope of the present invention. Parts and percentages are by weight unless otherwise indicated.

EXAMPLE I 1,091 Grams of copper iodide and 273 grams of a 30 percent (by weight) gel content partially crosslinked polyester resin, obtained by the reactive extrusion of a linear polyester, which linear polyester was obtained from the polymeric esterification of the dicarboxylic acid fumaric acid, and propoxylated bisphenol A, reference U.S. Pat. Nos. 5,376,494 and 5,227,460, the disclosures of each patent being totally incorporated he were combined and processed in an extruder (APV) with the following process parameters: 260° F. barrel temperature, 260° F. die head temperature, 57 percent load, a feed rate of 11.4 grams per minute, and a tool speed of 150 rotations per minute. The resulting extrudate comprised of 80 percent copper iodide by weight dispersed uniformly in the polyester polymer resin was size reduced by mechanical attrition in an 0202 Jet-O-Mizer (Fluid Energy Aljet) with the following process parameters: feed pressure of 100 pounds per square inch, grinding pressure of 100 pounds per square inch, and a feed rate of 146 grams per minute. The volume median particle size after mechanical attrition was 5.2 microns.

In the first step of the two step carrier coating process, 4.55 kilograms of 100 micron spherical steel shot (Nuclear Metals, Inc.) was mixed with 68 grams of a carbon black-loaded poly(methylmethacrylate) with about 20 weight percent of Conductex SC Ultra conductive carbon black produced with a volume median particle size of 2 microns in a chemical process prior to mixing. The mixing was accomplished in a Munson M5R Minimixer blender with the following process conditions: blender speed 50 rotations per minute and a blend time of 30 minutes. There resulted uniformly distributed and electrostatically attached, as determined by visual observation, on the carrier core the polymer with carbon black therein. Thereafter, the resulting carrier particles were inserted into a rotating tube furnace for a period of 30 minutes. This furnace was maintained at a temperature of 400° F. polymer with carbon black to melt and fuse to the core.

The second step of the two step carrier coating process comprised mixing the output of the above first step of the process, that is polymer with carbon black, with the above prepared 80 percent copper iodide dispersed in the 30 percent gel polyester resin at a concentration of 0.5 percent by weight. This mixing was accomplished in a Munson M5R Minimixer blender with the following process conditions: blender speed 50 rotations per minute and a blend time of 30 minutes. There resulted uniformly distributed and electrostatically attached, as determined by visual observation, on the powder resulting from the first step of the process the copper iodide/polymer material. The resulting mixture with two polymer coatings was then placed in a rotating kiln furnace for 30 minutes to reach a peak temperature of 400° F. This functions to primarily fuse the cuprous iodide loaded polyester onto the surface of the carbon black loaded poly (methylmethacrylate). The final product was comprised of a carrier core with a total of 2 percent polymer mixture by weight on the surface with the polymer being a combination of 75 percent by weight of the carbon black loaded poly (methylmethacrylate) and 25 percent by weight of the copper iodide loaded polyester.

A developer composition was then prepared by mixing 194 grams of the above prepared carrier with 6 grams of a toner composition comprised of 87 percent by weight of a 30 percent (by weight) gel content partially crosslinked polyester resin, obtained by the reactive extrusion of a linear polyester, reference the same polyester selected for the polymer coating above, 5 percent by weight of carbon black, 4 percent by weight of a polypropylene wax, and 4 percent by weight of a compatibilizing agent comprised of KRATON™ obtained from Shell Chemicals.

Thereafter, the triboelectric charge on the carrier particles was determined by the known Faraday Cage process, and there was measured on the carrier a charge of 8.5 microcoulombs per gram. Further, the conductivity of the carrier as determined by forming a 0.1 inch long magnetic brush of the carrier particles, and measuring the conductivity by imposing a 10 volt potential across the brush was $2.9\times10^{-8}$ mho-cm$^{-1}$. Therefore, these carrier particles were conducting.

In all the Examples, the triboelectric charging values and the conductivity numbers were obtained in accordance with the aforementioned procedure.

EXAMPLE II

The process of Example I was repeated, except that the second step of the carrier coating process comprised the mixing of the output of the first step of the process, that is polymer with carbon black, with the 80 percent copper iodide dispersed in polyester resin particles at a concentration of 1.0 percent by weight. The final product was comprised of a carrier core with a total of 2.5 percent polymer mixture by weight on the surface with the polymer mixture being a combination of 60 percent by weight of carbon black loaded poly(methylmethacrylate) first polymer, and 40 percent by weight of copper iodide loaded polyester second polymer.

A developer composition was then prepared by mixing 194 grams of the above prepared carrier particles with 6 grams of a toner composition comprised of 87 percent by weight of a crosslinked polyester resin, 5 percent by weight of carbon black, 4 percent by weight of a 5 polypropylene wax, and 4 percent by weight of a compatibilizing agent comprised of KRATON™ obtained from Shell Chemicals.

Thereafter, the triboelectric charge on the carrier particles was determined by the known Faraday Cage process, and there was measured on the carrier a charge of −3.8 microcoulombs per gram. Further, the conductivity of the carrier as determined by forming a 0.1 inch long magnetic brush of the carrier particles, and measuring the conductivity by imposing a 10 volt potential across the brush was $2.6\times10^{-10}$ mho-cm$^{-1}$. Therefore, these carrier particles were semiconducting.

EXAMPLE III

The procedure of Example I was repeated, except that the second step of the carrier coating process involved mixing the output of the first step of the process with the 80 percent copper iodide dispersed in polyester resin particles at a concentration of 1.5 percent by weight. The final product was a carrier core with a total of 3 percent polymers by weight on the surface with the polymer mixture being a combination of 50 percent by weight carbon black loaded poly(methylmethacrylate) and 50 percent by weight copper iodide loaded polyester.

A developer composition was then prepared by mixing 194 grams of the above prepared carrier particles with 6 grams of a toner composition comprised of 87 percent by weight of a crosslinked polyester resin, 5 percent by weight of carbon black, 4 percent by weight of a polypropylene wax, and 4 percent by weight of a compatibilizing agent comprised of KRATON™ obtained from Shell Chemicals.

Thereafter, the triboelectric charge on the carrier particles was determined by the known Faraday Cage process, and there was measured on the carrier a charge of −7.9 microcoulombs per gram. Further, the conductivity of the carrier as determined by forming a 0.1 inch long magnetic brush of the carrier particles, and measuring the conductivity by imposing a 10volt potential across the brush was $8.5\times10^{10}$ mho-cm$^{-1}$. Therefore, these carrier particles were semiconducting.

EXAMPLE IV 1,091 Grams of copper iodide and 273 grams of a poly(styrene-butadiene) resin, 91/9 styrene/butadiene, were combined and processed in an extruder (APV) with the following process parameters: 400° F. (degrees F. throughout) barrel temperature, 350° F. die head temperature, 26 percent load, a feed rate of 23 grams per minute, and a tool speed of 150 rotations per minute. The resulting extrudate of 80 percent copper iodide by weight dispersed uniformly in the styrene/butadiene polymer resin was size reduced by mechanical attrition in a 15 inch Sturtevant Fluid Energy Mill with the following process parameters: feed pressure of 100 pounds per square inch, grinding pressure of 100 pounds per square inch, and a feed rate of 146 grams per minute. The volume median particle size after mechanical attrition was 5.2 microns.

In the carrier coating process, 85 grams of the above prepared 80 percent by weight copper iodide powder was mixed with 28 grams of a carbon black-loaded poly (methylmethacrylate) with a volume median particle size of 2 microns in a chemical process prior to admixing the two polymers. This powder mixture was then combined with 4.55 kilograms of 100 micron spherical steel shot (Nuclear Metals, Inc.) in a Munson M5R Minimixer blender with the following process conditions: blender speed of 50 rotations per minute and a blend time of 30 minutes. There resulted uniformly distributed and electrostatically attached, as determined by visual observation, on the carrier core the two polymer mixture. Thereafter, the resulting carrier particles were inserted into a rotating tube furnace for a period of 30 minutes. This furnace was maintained at a temperature of 400° F. thereby causing the polymer to melt and fuse to the core.

A developer composition was then prepared by mixing 194 grams of the above prepared carrier particles with 6 grams of a toner composition comprised of 87 percent by weight of the crosslinked polyester resin, 5 percent by weight of carbon black, 4 percent by weight of a polypropylene wax, and 4 percent by weight of a compatibilizing agent comprised of KRATON™ obtained from Shell Chemicals.

Thereafter, the triboelectric charge on the carrier particles was determined by the known Faraday Cage process, and there was measured on the carrier a charge of −4.7 microcoulombs per gram. Further, the conductivity of the carrier as determined by forming a 0.1 inch long magnetic brush of the carrier particles, and measuring the conductivity by imposing a 10 volt potential across the brush was $7.6\times10^{-8}$ mho-cm$^{-1}$. Therefore, these carrier particles were conducting.

EXAMPLE V

The procedure of Example I was repeated, except that the carrier coating process involved mixing 45 grams of the 80 percent by weight copper iodide powder with 45 grams of the carbon black-loaded poly(methylmethacrylate) with a volume median particle size of 2 microns, and generated in a chemical process prior to mixing.

A developer composition was then prepared by mixing 194 grams of the above prepared carrier particles with 6 grams of a toner composition comprised of 87 percent by weight of a crosslinked polyester resin, 5 percent by weight of carbon black, 4 percent by weight of a polypropylene wax, and 4 percent by weight of a compatibilizing agent comprised of KRATON™ obtained from Shell Chemicals.

Thereafter, the triboelectric charge on the carrier particles was determined by the known Faraday Cage process, and there was measured on the carrier a charge of 4.5 microcoulombs per gram. Further, the conductivity of the carrier as determined by forming a 0.1 inch long magnetic brush of the carrier particles, and measuring the conductivity by imposing a 10 volt potential across the brush was $5.5\times10^{-1}$. Therefore, these carrier particles were conducting.

EXAMPLE VI

The procedure of Example IV was repeated, except that the carrier coating process involved mixing 16 grams of this 80 percent by weight copper iodide powder with 48 grams of a carbon black-loaded poly(methylmethacrylate) produced with a volume median particle size of 2 microns in a chemical process prior to mixing the two polymers. Thereafter, the remainder of the process is identical to that of Example IV.

A developer composition was then prepared by mixing 194 grams of the above prepared carrier particles with 6 grams of a toner composition comprised of 87 percent by weight of a crosslinked polyester resin, 5 percent by weight of carbon black, 4 percent by weight of a polypropylene wax, and 4 percent by weight of a compatibilizing agent comprised of KRATON™ obtained from Shell Chemicals.

Thereafter, the triboelectric charge on the carrier particles was determined by the known Faraday Cage process, and there was measured on the carrier a charge of 7.9 microcoulombs per gram. Further, the conductivity of the carrier as determined by forming a 0.1 inch long magnetic brush of the carrier particles, and measuring the conductivity by imposing a 10 volt potential across the brush was $1.1\times10^{-6}$ mho-cm$^{-1}$. Therefore, these carrier particles are conducting.

The toner carbon black selected for the above Examples was, unless otherwise indicated, REGAL 330®; the polypropylene was of a low molecular weight, about 7,000 it is believed, and was obtained from Sanyo Chemicals of Japan, or VISCOL 660P®; and the KRATON™ compatibilizer was a styrene-ethylene-butylene styrene block copolymer (Shell KRATON G 1726X®), reference U.S. Pat. No. 5,229,242, the disclosure of which is totally incorporated herein by reference.

Other embodiments and modifications of the present invention may occur to those of ordinary skill in the art subsequent to a review of the present application and the information presented herein; these embodiments and modifications, as well as equivalents thereof, are also included within the scope of the present invention.

What is claimed is:

1. A carrier consisting essentially of a core and thereover a mixture of a first and second polymer, and wherein said first polymer contains a conductive component different from copper iodide, and said second polymer contains copper iodide, and wherein said copper iodide is present in the amount of from about 80 to about 95 weight percent based on the amount of said second polymer and said iodide.

2. A carrier in accordance with claim 1 wherein the copper iodide is cuprous iodide present in an amount of from about 80 to about 95 weight percent based on the amount of said second polymer and said iodide, and there results carrier particles.

3. A carrier in accordance with claim 2 wherein said conductive component for said first polymer is a metal oxide.

4. A carrier in accordance with claim 2 wherein said conductive component for said first polymer is carbon black.

5. A carrier in accordance with claim 2 wherein said conductive component for said first polymer is carbon black selected in an amount of from about 15 to about 60 weight percent.

6. A carrier in accordance with claim 2 wherein said first polymer is a polyester, or a styrene based polymer, and said second polymer is polymethylmethacrylate.

7. A carrier in accordance with claim 2 wherein said first polymer is selected in an amount of form about 1 to about 99 weight percent and said second polymer is selected in an amount of from about 99 to about 1 weight percent.

8. A carrier in accordance with claim 2 wherein said core is a metal.

9. A carrier in accordance with claim 2 wherein said core is a ferrite.

10. A carrier in accordance with claim 2 wherein said core is a metal oxide.

11. A process for the preparation of a carrier which comprises (1) mixing carrier core with a mixture of a first and second polymer, and wherein satd first polymer contains a conductive component, different from copper iodide and said second polymer contains cuprous iodide in an amount of from about 80 to about 95 weight percent; (2) dry mixing the resulting carrier core for a sufficient period of time enabling the polymers to adhere to the carrier core; (3) subsequently heating the mixture of carrier core particles and polymer to a temperature of between about 200° F. and about 550° F., whereby the polymers melt and fuse to the carrier core; and (4) thereafter cooling the resulting coated carrier particles.

12. A process in accordance with claim 11 wherein the cuprous iodide is present in an amount of at least about 80 weight percent.

13. A process in accordance with claim 11 wherein the cuprous iodide is present in an amount of 80 weight percent.

14. A process in accordance with claim 11 wherein the conductive component is a conductive carbon black.

15. A process in accordance with claim 13 wherein the conductive component is carbon black present in an amount of from about 15 to about 60 weight percent.

16. A process in accordance with claim 14 wherein the carbon black is present in an amount of from about 15 to about 40 weight percent.

17. A process in accordance with claim 11 wherein the conductive component is carbon black present in an amount of from about 16 to about 20 weight percent.

18. A process in accordance with claim 11 wherein the conductive component is a conductive carbon black present in an amount of from about 15 to about 50 weight percent, the cuprous iodide is present in an amount of from about 80 to about 95 weight percent, the carrier conductivity is from about $10^{-6}$to about $10^{-15}$ (ohm-cm)$^{-1}$, and the carrier triboelectric charge is from about a minus 30 to about a positive 40 microcoulombs per gram.

19. A process in accordance with claim 11 wherein the conductive component is a conductive carbon black present in an amount of from about 15 to about 25 weight percent, the carrier conductivity is from about $10^{-7}$ to about $10^{-8}$ (ohm-cm)$^{-1}$, and the carrier triboelectric charge is from about a minus 30 to about a positive 30 microcoulombs per gram.

20. A process in accordance with claim 11 wherein the first polymer is polymethylmethacrylate and the second polymer is a polyester.

21. A process in accordance with claim 11 wherein the carrier core is selected from the group consisting of iron, ferrites, steel and nickel.

22. An improved process for the preparation of carrier particles with an extended triboelectric charging range and with an extended conductivity range, which process comprises mixing a carrier core with a polymer mixture, and which mixture comprises a first and second polymer having dispersed therein, respectively, carbon black and cuprous iodide, followed by heating until the polymers fused to the core, and thereafter cooling, and wherein said carbon black is present in an amount of from about 18 to about 50 weight percent, and said cuprous iodide is present in an amount of from about 80 to about 95 weight percent, and wherein said first polymer is polymethacrylate.

23. A developer comprised of toner and the carrier of claim 1.

24. A process in accordance with claim 22 with from about 0.1 to 3.0 percent of carrier coating polymer mixture by weight and containing said conductive component present in an amount of from about 5 to about 60 weight percent, and which carrier possesses a conductivity of from about $1\times10^{-8}$ mho/centimeter to about $1\times10^{-15}$ mho/centimeter, and a triboelectric value of from about a minus 30 to plus 30 microcoulombs per gram.

25. A carrier in accordance with claim 1 wherein said copper iodide is present in an amount of about 80 weight percent.

26. A carrier in accordance with claim 1 wherein the carrier possesses a high conductivity of from about $10^{-10}$ about $10^{-7}$ (ohm-cm)$^{-1}$.

27. A carrier consisting of a core end thereover a mixture of first and second polymers, and wherein said first polymer contains a conductive component different from copper iodide and said second polymer contains copper iodide, and wherein said copper iodide is present in an amount of about 80 to about 90 weight percent and the conductivity of the resulting carrier is from about $10^{-10}$ to about $10^{-7}$ (ohm-om)$^{-1}$.

28. A carrier in accordance with claim 27 wherein said conductivity is from about $10^{-7}$ to about $10^{-8}$ (ohm-cm)$^{-1}$.

* * * * *